US010583684B2

(12) United States Patent
Lehmann

(10) Patent No.: US 10,583,684 B2
(45) Date of Patent: Mar. 10, 2020

(54) INSERTING SYSTEM

(71) Applicant: Kern AG, Konolfingen (CH)

(72) Inventor: Urs Lehmann, Grosshochstetten (CH)

(73) Assignee: KERN AG, Konolfingen (CH)

( * ) Notice: Subject to any disclaimer, the term of this patent is extended or adjusted under 35 U.S.C. 154(b) by 379 days.

(21) Appl. No.: 15/505,396

(22) PCT Filed: Aug. 7, 2015

(86) PCT No.: PCT/EP2015/068224
§ 371 (c)(1),
(2) Date: Feb. 21, 2017

(87) PCT Pub. No.: WO2016/026712
PCT Pub. Date: Feb. 25, 2016

(65) Prior Publication Data

US 2017/0267017 A1 Sep. 21, 2017

(30) Foreign Application Priority Data

Aug. 22, 2014 (CH) ..... 1261/14

(51) Int. Cl.
*B43M 3/04* (2006.01)

(52) U.S. Cl.
CPC ..... *B43M 3/045* (2013.01)

(58) Field of Classification Search
CPC ..... B43M 3/045; B43M 5/042; B43M 7/00; B65H 2801/66; B65B 5/04; B65B 25/24
(Continued)

(56) References Cited

U.S. PATENT DOCUMENTS 2,019,211 A * 10/1935 Clare ..... B43M 5/042 53/284.3
2,915,863 A 12/1959 Kummer
(Continued)

FOREIGN PATENT DOCUMENTS

| | | |
|---|---|---|
| EP | 2 756 964 B1 | 7/2014 |
| FR | 2 543 491 A1 | 10/1984 |
| FR | 2 859 945 A1 | 3/2005 |

OTHER PUBLICATIONS

International Search Report for PCT/EP2015/068224 dated Jan. 12, 2016.

*Primary Examiner* — Robert F Long
*Assistant Examiner* — Xavier A Madison
(74) *Attorney, Agent, or Firm* — Pearne & Gordon LLP

(57) ABSTRACT

A system for inserting contents in an envelope includes a holder for empty envelopes, a flap opener, conveying elements for conveying the envelope from the holder to a packing pocket where the envelopes are filled, a supply device for supplying the envelope contents to and into the packing pocket, and removal elements for forwarding the filled envelope. The conveying elements include a funnel for orientation of the envelope relative to the packing pocket. The funnel is mobile at a first angle (W1) with respect to a flap guide of the packing pocket. The conveying elements further include a pulling means for pulling the envelope over the packing pocket. The pulling means cooperates temporarily with the flap guide of the packing pocket and is mobile at a second angle (W2) with respect to the flap guide. The conveying elements include means for synchronizing the movement of the funnel and the pulling means.

49 Claims, 9 Drawing Sheets

(58) Field of Classification Search
USPC ..... 53/473
See application file for complete search history.

(56) References Cited

U.S. PATENT DOCUMENTS

| | | | | |
|---|---|---|---|---|
| 4,674,258 | A * | 6/1987 | Ehlscheid | B43M 3/045 53/154 |
| 5,642,598 | A * | 7/1997 | Cannaverde | B43M 3/045 53/284.3 |
| 5,944,304 | A * | 8/1999 | Branecky | B43M 3/045 270/58.06 |
| 6,732,494 | B1 * | 5/2004 | Nolte | B65D 27/14 53/459 |
| 2005/0060966 | A1 * | 3/2005 | Ballestrazzi | B43M 3/045 53/569 |

* cited by examiner

INSERTING SYSTEM

The present invention relates to an inserting system comprising a funnel and at least one pulling means for transporting the envelopes onto a packing pocket, and to a method for operating an inserting system.

EP 0 504 114 B1 discloses an inserting system which can more or less double the speed in comparison to the prior art known at that time. In said document, a rotatably mounted packing pocket and a holding-down roller are controlled via levers by a cam. The large number of rapidly moving parts required for this is expensive to manufacture and, on account of the relatively large moving mass, hinders any further increased packing output. In addition, the moving packing pocket leads to undesirable vibrations which likewise limit the packing output. Furthermore, in such a system, in order to ensure optimal guidance of the envelope and of the envelope contents to be guided through the packing pocket, a different packing pocket has to be installed for each envelope size that differs in terms of width, that is to say the dimension transverse to the transport direction of the envelope, which packing pocket is moreover suitable only for a very limited range of thickness of the contents to be packed. Such a changeover is difficult due to the movable guidance of the packing pocket.

It is an object of the present invention to avoid the disadvantages of the prior art and to provide an inserting system by which the packing speed can be further increased, for example to 30,000 to 40,000 packing operations per hour. In addition, it is an object of the invention to provide a packing pocket which does not have to be moved during the inserting operation, in order to avoid disruptive vibrations. Finally, it is also an object of the invention to provide an inserting system for different envelope blanks and/or envelope contents. The intention is therefore that, by virtue of a particularly precise guidance, even envelopes having a short or straight flap can be reliably packed, whereas the prior art requires flaps that as far as possible taper to a point so that they come to lie on the guide surface of the packing pocket as early as possible, and thus facilitate the guiding and opening of the envelopes. In addition, the intention is also for it to be possible to process reliably even envelopes which have become warped due to a reduced quality or poor storage, which is not possible in the prior art.

An inserting system which achieves the stated objects and avoids the disadvantages of the prior art is disclosed in claim 1, and a corresponding method is disclosed in claim 30. Further preferred embodiments can be found in the dependent claims.

The inserting system designed for inserting envelope contents into an envelope comprises a holder for empty envelopes, a flap opener for opening the envelope flaps, transport elements for transporting the envelopes from the holder to a packing pocket on which the envelopes are filled, a supply device for supplying the envelope contents to and into the packing pocket, and onward transport elements for the onward conveying of the filled envelope. The transport elements comprise a funnel-shaped element, hereinafter referred to as the funnel, for aligning the envelope with the packing pocket, said funnel being movable in a first angle (W1) relative to a flap guide of the packing pocket which is mounted on the inserting system or on a mounting rail. Here, a funnel will be understood in principle to mean any arrangement of two or more subunits which are able to receive the envelope in a funnel-like manner, as seen in the longitudinal section of the transport plane, and guide it onward, for example two parallel rows of rollers operating in opposite directions (and also of different size), one row of rollers which together with an angle profile forms the funnel, or a plurality of angle profiles, as will be discussed in greater detail below. The transport elements also comprise at least one pulling means for pulling the envelope at least partially, but preferably completely, onto the packing pocket, said pulling means cooperating temporarily with the flap guide of the packing pocket and being movable in a second angle (W2) relative to the flap guide. The envelope is in this case pushed onto the packing pocket by the transport roller and counter-roller and, at the latest at the time at which the rear edge of the envelope is no longer in engagement between the transport roller and the counter-roller, but preferably already earlier in order to prevent buckling, is pulled onto the packing pocket by one or more pulling rollers until the envelope bottom arrives at the front edge of the packing pocket.

The funnel and the pulling means, which for example may preferably comprise at least one pulling roller, are controlled here by synchronizing means which are likewise provided. The funnel and the pulling means are moved from a first position for receipt of the envelope flap by the funnel into a second position after the envelope flap has been placed onto the outer side of the flap guide that faces away from the sheet guide or the guide for the contents, as a result of which a transport angle (Wt) between the supplied envelope and the flap guide or a plane K that includes the flap guide can be varied during the pulling of the envelope onto the packing pocket, in order to enable easy opening of the envelope, as a result of which the front edge or tip of the packing pocket as seen in the transport direction can be introduced into the envelope. The means for synchronizing the movement are advantageously dimensioned and actuated in such a way that the movement, which starts immediately after the envelope flap has been placed onto the flap guide, is concluded after the flap fold has been placed onto the flap guide, that is to say substantially within one flap length. The envelopes may be supplied from above or from below, wherein the transport angle (Wt) in the first position is between 15° and 45°, preferably between 20° and 40°, particularly preferably around 30°±5°. In the second position, the transport angle (Wt) is smaller than in the first position and is preferably between −10° and 10°, particularly preferably between 0° and 6°.

As the means for synchronizing the movement of the funnel and of the pulling means, use may be made of synchronous motors, but preferably, due to the greater robustness and more favorable manufacturing costs, of mechanical transmission means such as toothed wheels, toothed belts, chains, drive belts, which particularly preferably comprise a guide cam. The latter, which may be embodied for example as a cam disk or cam lobe, has a particularly high stability and accuracy while at the same time having low costs and a low maintenance requirement for a rapidly oscillating operation of the moving parts, as in the present case. The funnel, which is designed to guide the envelope passing through into the transport plane, can be constructed in a particularly simple manner by two angle profiles which are arranged on opposite sides and transversely to the transport direction. In this case, the angle profiles are arranged parallel to and against one another, as a result of which a point of deflection of the transport plane or transport path of the envelope can be defined (for example in position II). Advantageously, the angle profiles are open at the side or at least over the entire width of the transport plane or else beyond this, so that envelope blanks of different width can be transported. The funnel or the angle profiles may be mounted on a common funnel base which is able to be moved by the synchronizing means.

In order to transport the envelope through the funnel onto the packing pocket as far as the pulling means, a transport roller which cooperates with a preferably spring-biased counter-roller may be arranged upstream of the funnel counter to the transport direction of the envelope. An onward transport roller and a further onward transport element cooperating therewith may be provided downstream of the packing pocket in the onward transport direction of the envelope in order to convey the filled envelope onward from the packing pocket. The further onward transport element may be a segment, preferably a segment which can be spring-biased against the onward transport roller, preferably a segment which is made of elastic material at least in the surface region or a segment which can be moved by a spring. Advantageously, a transport roller may be arranged in this region, and namely between the transport plane and the onward transport plane, in order to cooperate alternately, or at least in some instances also simultaneously, on the one hand with the counter-roller as the transport element and on the other hand with the further onward transport element itself as the onward transport element. Such an arrangement is particularly economical both with regard to the construction and with regard to the speed of the inserting operation since in this case, while the envelope to be supplied is already running between the transport roller and the counter-pressure roller toward the packing pocket, the envelope filled from the preceding filling cycle can be transported away between the same transport roller and the segment. The onward transport angle (Wa) from the front edge of the packing pocket is advantageously acute and directed downward in order to prevent the envelope contents from slipping out during the onward transport. Advantageously, the onward transport angle (Wa) formed between a plane, which is spanned between the front edge of the packing pocket and the mid-line of an envelope guide gap arranged between the onward transport roller/transport roller and the further transport element, and the plane K that includes the flap guide is selected in a range between 1° to 12°. Despite the high and accelerating transport and onward transport speeds that can be set, such a small acute angle is surprisingly already sufficient to prevent, in collaboration with the onward transport elements, the envelope contents from slipping out or sliding. In the case of envelopes being supplied from below, the angle can be selected between 1° and 6°, but preferably between 2° and 4°, and in the case of envelopes being supplied from above the angle can be selected between 5° and 12°, preferably between 6° and 10°, always directed downward. In principle, such an inserting system can and usually will also comprise further transport elements and/or onward transport elements, such as for example further rollers, belts or/and segments.

A flap opener, which is preferably arranged downstream in the region of the holder for empty envelopes with a closed flap, may be designed for example as an opener claw which is arranged on a circular circumference. Alternatively or in addition, in a manner assisting the opener claw, the flap opener may comprise a blowing unit 61 (FIG. 1) for generating an air flow that is directed below the envelope flap.

For supplying the envelope contents, the supply device may comprise fingers attached to toothed belts or drive belts or chains. Said fingers may be guided for example through slots in the packing pocket from one side to protrude beyond the other side of the supply plane. Alternatively, the transport fingers may also be guided between the slats, as described below, of a segmented packing pocket.

The movement angle of the funnel or of the movable pulling means relative to a plane defined by the flap guide may in principle be selected to be the same or different for the two angles W1 and W2, depending on geometric conditions, for example may be selected in a range between 70° to 150°, the limit values being included. By way of example, the first angle (W1) may in particular lie in a range from 90° to 150°, particularly preferably in a range from 110° to 130°, relative to the plane K that includes the flap guide, whereas the second angle (W2) lies in a range from 70° to 110°, preferably in a range from 80° to 100°, relative to the plane K that includes the flap guide. In this case, the side of the flap guide is preferably selected to be substantially horizontal, whereby the plane K is preferably substantially identical to the horizontal plane. Both the first and the second angle will preferably also be able to be varied by pivoting, which takes place for example by a rotationally movable mounting of the funnel or/and of the pulling means or corresponding guidance of the two transport elements.

In order additionally to assist the opening of the envelope and thus to facilitate the pulling thereof onto the packing pocket, cones which are preferably adjustable and which laterally delimit the flap guide plane may be provided between the funnel and the pulling means or the pulling roller.

In order to be able advantageously to load the inserting system also with different envelopes and envelope content formats, in particular different document formats, a packing pocket formed of multiple parts may be provided. Such a packing pocket can in principle also be used on other inserting systems which are suitable for different envelope formats or envelope content formats. In this case, the packing pocket has a mid-line M in a plane K, and also a plurality of slats which are parallel to the mid-line M and which are arranged with the respective flap guide in the flap guide plane K. Assigned to each slat is a sheet guide which is at a distance from the respective flap guide, as a result of which the packing space is defined, into which the envelope contents are supplied. The slats are arranged separately from one another on the inserting system or on a mounting rail, wherein additionally means are provided for displacing the outer (with respect to the mid-line) side slats, including the sheet guides assigned thereto, in order to displace these in parallel toward or away from one another substantially perpendicular to the mid-line. Particularly for processing wider envelope formats or envelope content formats, it is advantageous if at least one inner slat is provided in a stationary manner between the outer slats. These outer slats, also known as side slats, may be designed as a bracket or at least partially as a U-shaped profile with an outwardly directed base, so that the envelope contents are protected or/and guided on both sides by the U-shaped profile.

For better guidance of envelope contents of different thickness, the sheet guide may advantageously be designed to be flexible vertically relative to the flap guide, or relative to the plane K, at least in a front region, which is arranged at the front relative to the supply of envelopes, or else for the entire sheet guide, preferably to be flexible with a deviation of up to 10°. For example, a sheet guide made of flexible material may in the rear region be fixedly connected to the slat or to a mounting rail and then extend in a finger-like manner into the front region of the slat, directed at an angle, in particular at an acute angle, toward the latter. During the insertion of the envelope contents, which may additionally be assisted by an angled plane on the sheet guide and/or slat, the envelope contents are supported by the finger-like spring of the sheet guide, thereby preventing any premature touching of the envelope. The spring effect of the sheet guide will in this case advantageously be selected in such a way that envelope contents of different thickness can be supplied at a constant speed. In addition, in the case of thick envelope contents, said spring prevents the envelope from being pushed out prematurely. As a result, the mechanical stress on the open envelope during the insertion of the envelope contents can be lowered and excessive deformation or even tearing can be avoided. Further alternatives, such as for example a sheet guide that is itself biased by springs 63 (FIG. 10), or sheet guides biased by sprung hinges, can also be used.

Due to the spring effect, the envelope is tensioned so that on the one hand envelope contents of different thickness can be processed and on the other hand the envelope is slowed so that the contents are pushed away from the packing pocket only after the insertion operation is complete, and not during it.

The adjusting means for displacing the side slats may comprise electrical or mechanical means, preferably an adjusting spindle. In order to guide the envelope contents, the outer slats are advantageously closed on the respective outer side surface. In contrast, the two side surfaces of the at least one inner slat are open.

In a method according to the invention for operating an inserting system as described in greater detail above, firstly in a known manner, from a stack of envelopes stored in the holder, the flap of the envelope located closest to an envelope removal opening of the holder is opened by a flap opener. The envelope is then transported by transport elements from the holder to a packing pocket, on which the envelopes are filled. The envelope contents are supplied to the packing pocket by means of a supply device and then the filled envelope is conveyed onward by onward transport elements.

In order to enable the most precise possible guidance even of different envelope formats, the envelopes are aligned in the direction of the packing pocket by a movable funnel, wherein said funnel is moved in a first angle (W1) relative to the flap guide of the packing pocket. At the same time, the envelope is at least partially, but preferably completely, pulled onto the packing pocket by at least one pulling means, preferably a pulling roller, which is moved in a second angle (W2) relative to the flap guide, wherein the pulling means or the pulling roller(s) cooperates at least temporarily, for example periodically, with the packing pocket. In addition, means for synchronizing the movement of the funnel and of the pulling means are used, which synchronizing means move these from a first position for receipt of the envelope flap by the funnel into a second position after the envelope flap has been placed onto the flap guide. As a result, a transport angle (Wt) between the supplied envelope and the flap guide is varied during the pulling of the envelope onto the packing pocket, in order to facilitate opening of the envelope. In position I, the transport angle (Wt) is advantageously in a range between 15° and 45°, preferably between 20° and 40°, particularly preferably around 30°±5°. In position II, the transport angle is set in a range of ±10°, preferably between 0° and 6°, relative to the flap guide or flap guide side.

The angles W1 and W2 may be selected for example in a range between 70° to 150°, the limit values being included. The first angle (W1) is selected in particular in a range from 90° to 150°, preferably in a range from 110° to 130°, relative to the plane K that includes the flap guide, the limit values being included, whereas the second angle (W2) is selected in particular in a range from 70° to 110°, preferably in a range from 80° to 100°, relative to the plane K that includes the flap guide, the limit values being included. The angles W1 and W2 are preferably varied by a rotational movement during the movement from position I to position II and vice versa, for example within the range given above, wherein the change in angle along the movement path may be small. This is particularly advantageous for the funnel, since thereby the inclination of the funnel is also slightly changed and the envelope can be better aligned with the packing pocket. The movement may take place for example along a circular path or a movement similar to a circle. A particularly reliable and precise guidance of the movement is thus possible.

Individual aspects of the invention can be combined with one another, provided that they do not obviously rule one another out.

The principle of the present invention as well as various examples of possible embodiments will be discussed below with reference to the figures.

Figure 1:
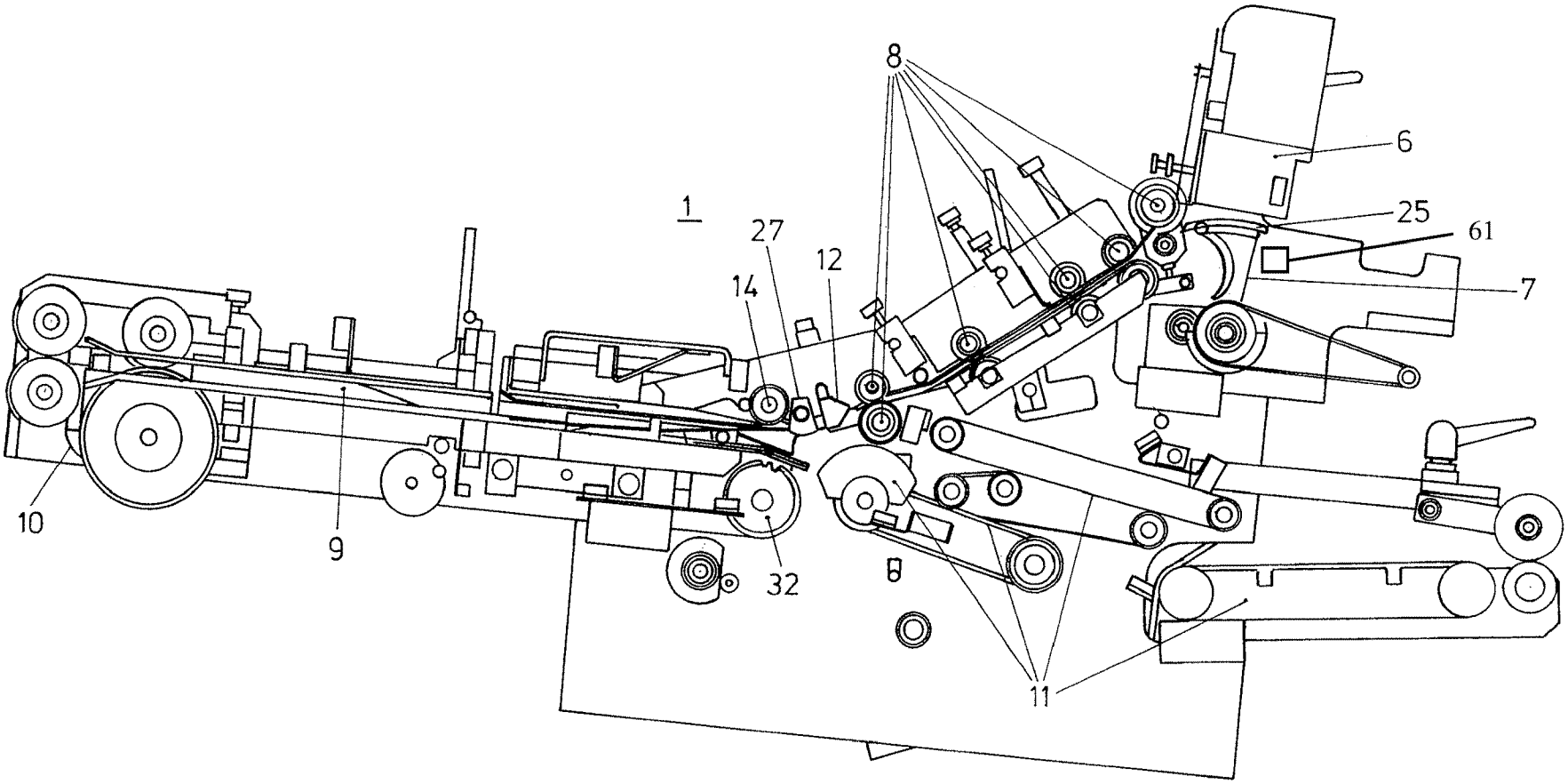
FIG. 1 shows a diagram of an inserting system according to the invention.

FIG. 1 shows a diagram of an inserting device according to the invention with envelopes being supplied from above. The envelopes, which are stored in a holder 6 for empty envelopes with the flap downward in the transport direction, are transported, after being opened by a flap opener 7 which comprises for example an opener claw 25, with the opened flap at the front by at least one transport element 8 in the direction of the packing pocket 9. For pulling onto the packing pocket, the envelope 2 is aligned with the packing pocket 9 by the funnel 12. The funnel 12 and the opening cones 27 help during the opening of the envelope 2 in order to pull the latter more easily onto the packing pocket. Once the envelope has been pulled on, said envelope is filled with the envelope contents 5 which are supplied via the supply device 10. Then, preferably without interrupting the movement of the envelope contents 5, the envelope is transferred by at least one insertion finger 26, which guides the envelope and the contents into the region of the funnel, to the onward transport elements 11 and is transported away.

Figure 2:
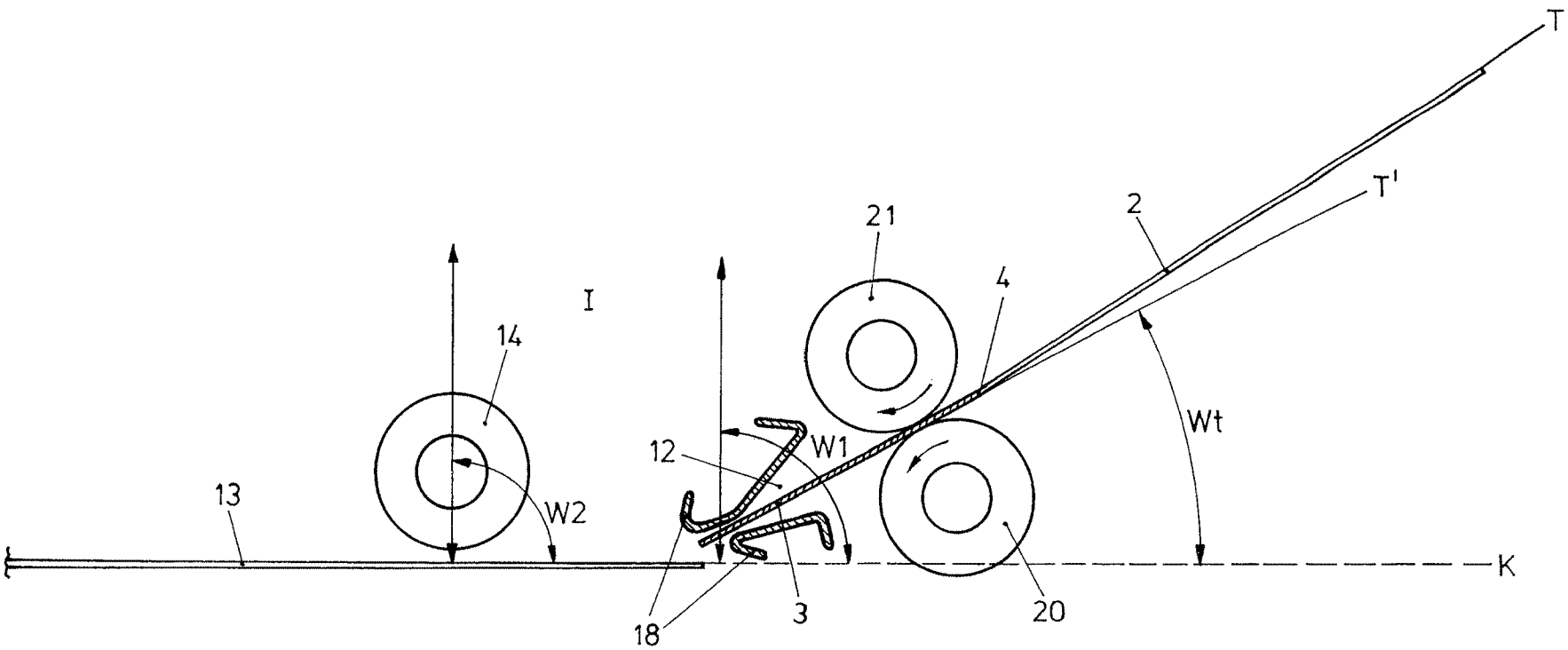
FIG. 2 shows a schematic diagram of the envelope supply.
Figure 3:
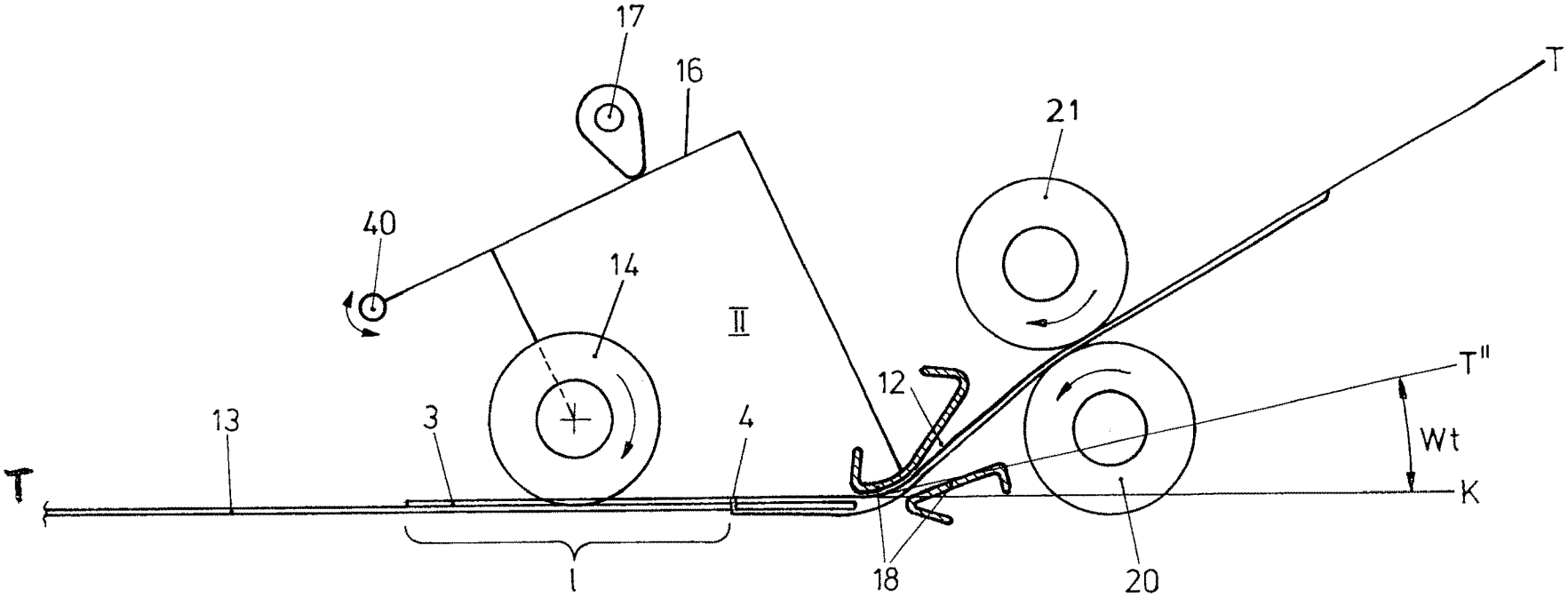
FIG. 3 shows a schematic diagram of the pulling of an envelope onto the packing pocket.
Figure 4:
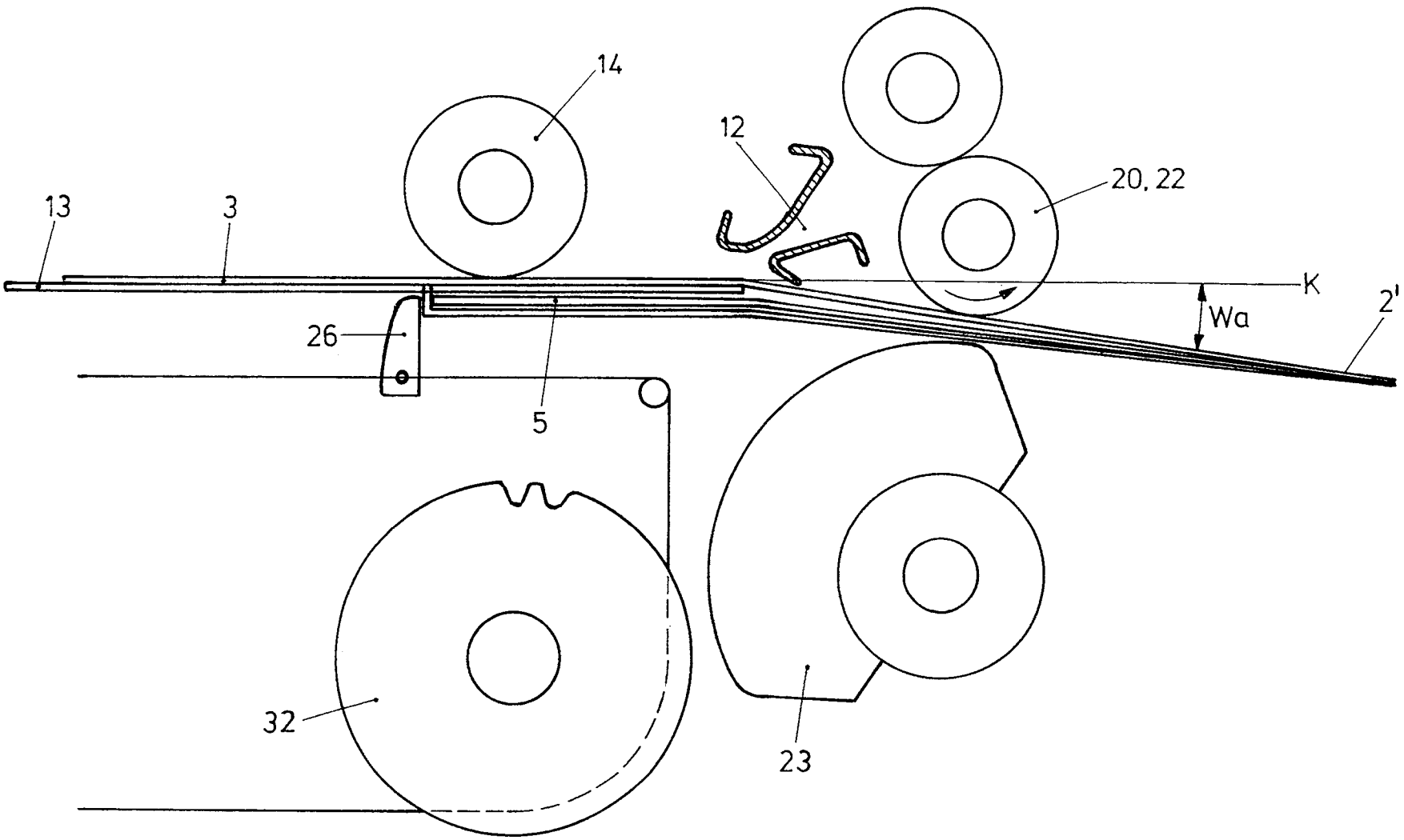
FIG. 4 shows a schematic diagram of the onward transport of an envelope away from the packing pocket.
Figure 8:
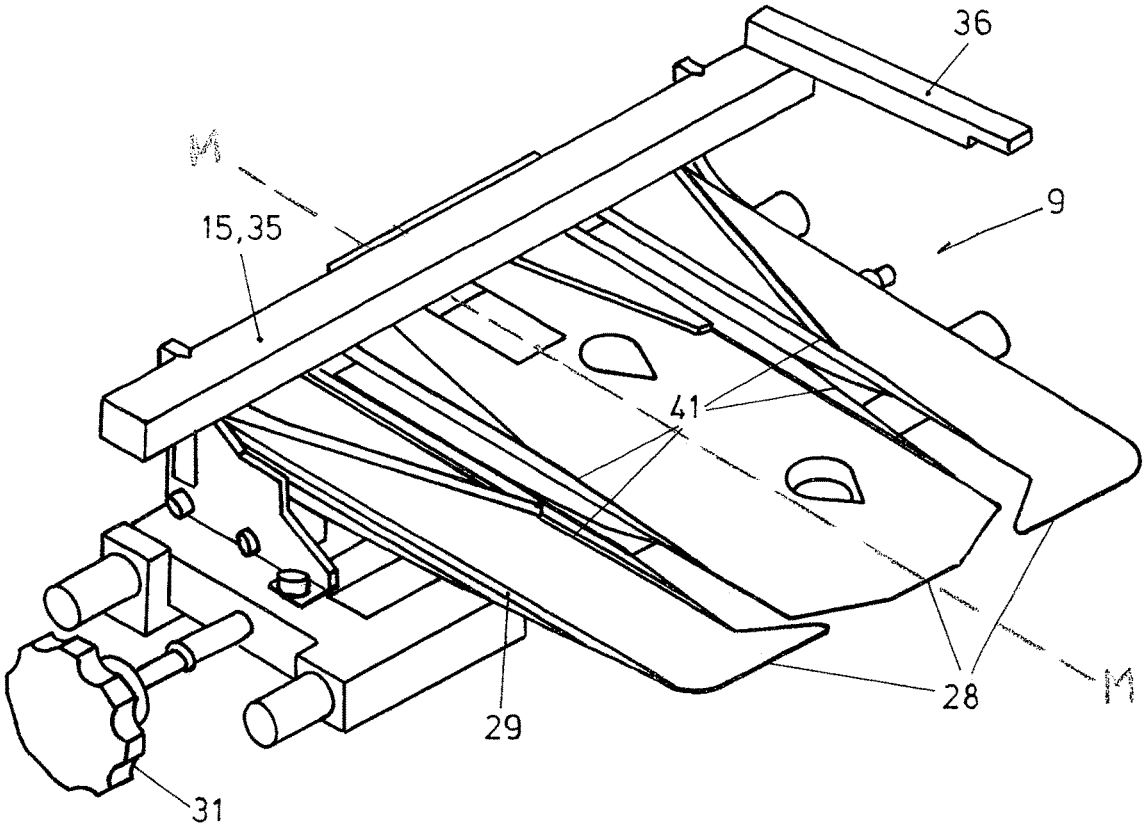
FIG. 8 shows a 3D view of a packing pocket.

FIGS. 2 to 4 show functional diagrams of the envelope being supplied, being pulled on and being transported away. As shown in FIG. 2, the envelope 2 is supplied, with the envelope flap 3 at the front, between a pair of rollers rotating in opposite directions, here the driven transport roller 20 and the counter-roller 21, which is advantageously spring-biased against the transport roller 20, through the funnel 12 at a transport angle (Wt), for example at an angle of between 25° and 35°, to the flap guide side of the packing pocket 9. During this, the funnel 12 and the pulling roller 14 are in a position I at a distance from the flap guide 13 or from a plane K that includes the flap guide side. In the case of a completely planar flap guide side, the latter is completely included by the plane K. Usually, however, the surface of the flap guide side is also formed by ribs or other elements on the spaced-apart slats. These elements may also pass through the plane K. By way of example, ribs 33 which rise at an angle toward the rear and which are intended to lift the front edge of the envelope flap and thus the entire flap, so that the finger of the supply device can pass through below the latter while itself extending over the flap guide plane K of the packing pocket, may be provided on the packing pocket in a region in the vicinity of or at the front edge of the packing pocket, as shown in FIG. 8. The finger in this case protrudes upward just out of the packing pocket plane so that no document is lost in the packing pocket. In this case, the flap guide side and the plane K are preferably oriented substantially horizontally.

Once the tip of the envelope flap 3 has been placed onto the flap guide 13, the funnel is set at an angle W1 and the pulling roller is set at an angle W2, in each case relative to the flap guide side or the plane defined by the latter. Advantageously, the first and second angle are selected in a range from 70° to 150°, the limit values being included.

Depending on the technical requirements and the space conditions of the inserting system actually created, the angles W1 and W2 may be different or else identical. The movement takes place via synchronizing means 16 which are shown schematically in FIG. 3 and which advantageously comprise a guide cam 17, for example in the form of a cam disk or cam lobe. The movement may take place in a rectilinear manner or else by a pivoting movement. By moving the funnel 12 as the envelope passes through, easy opening of the envelope 2 is made possible, and this can be further assisted by the cones 27 shown by way of example inter alia in FIG. 5. Advantageously, the movement of the funnel from the position 1 will be completed immediately before or during the placement of the flap tip onto the flap guide side, until the foremost edge of the packing pocket 9 has been passed by the flap fold 4, that is to say in the region of approximately one flap length l. Immediately before reaching the position II and/or also in position II, the funnel may press the envelope downward so far that a slightly negative transport angle Wt of the envelope relative to the flap guide plane is set. Advantageously, the transport angle in position II lies in the range of ±10°, preferably between 0° and 6°, relative to the flap guide. In this position II, the envelope 2 is then pulled completely onto the packing pocket by means of the pulling roller 14 which is lowered in synchronism with the movement of the envelope, and the envelope contents 5 are pushed through the packing pocket 9 into the envelope 2 by the supply device 10, which comprises for example at least one finger 26, which is attached to a toothed belt or a chain, and a supply drive 32. Then, after the pulling roller 14 has been raised away from the envelope 2' which has been pulled on and then packed, as shown in FIG. 4, the envelope is moved by the finger 26 in the direction of the segment 23 which cooperates with the transport roller 20 and/or a separate onward transport roller 22. Alternatively, the pulling roller 14 may also first be operated in the onward transport direction opposite to the pulling-on direction, in order to accelerate the envelope to the speed of continuously supplied envelope contents, as a result of which for example even particularly thin and/or delicate envelopes can be filled without reducing the speed of the envelope contents passing through into the packing pocket or without having to slow said contents too greatly. In any case, the pulling roller 14 and the funnel 12 are then returned synchronously to position I, while the onward transport elements 11, 20, 23 convey the envelope onward. The onward transport angle Wa is directed downward from the flap guide in order to avoid any slipping-out or sliding of the envelope contents 5. In inserting systems as shown in FIGS. 1 to 5, in which the envelope is supplied from above, advantageously an onward transport angle Wa of 5-12°, preferably between 6-10°, in the downward direction can be selected.

Figure 5:
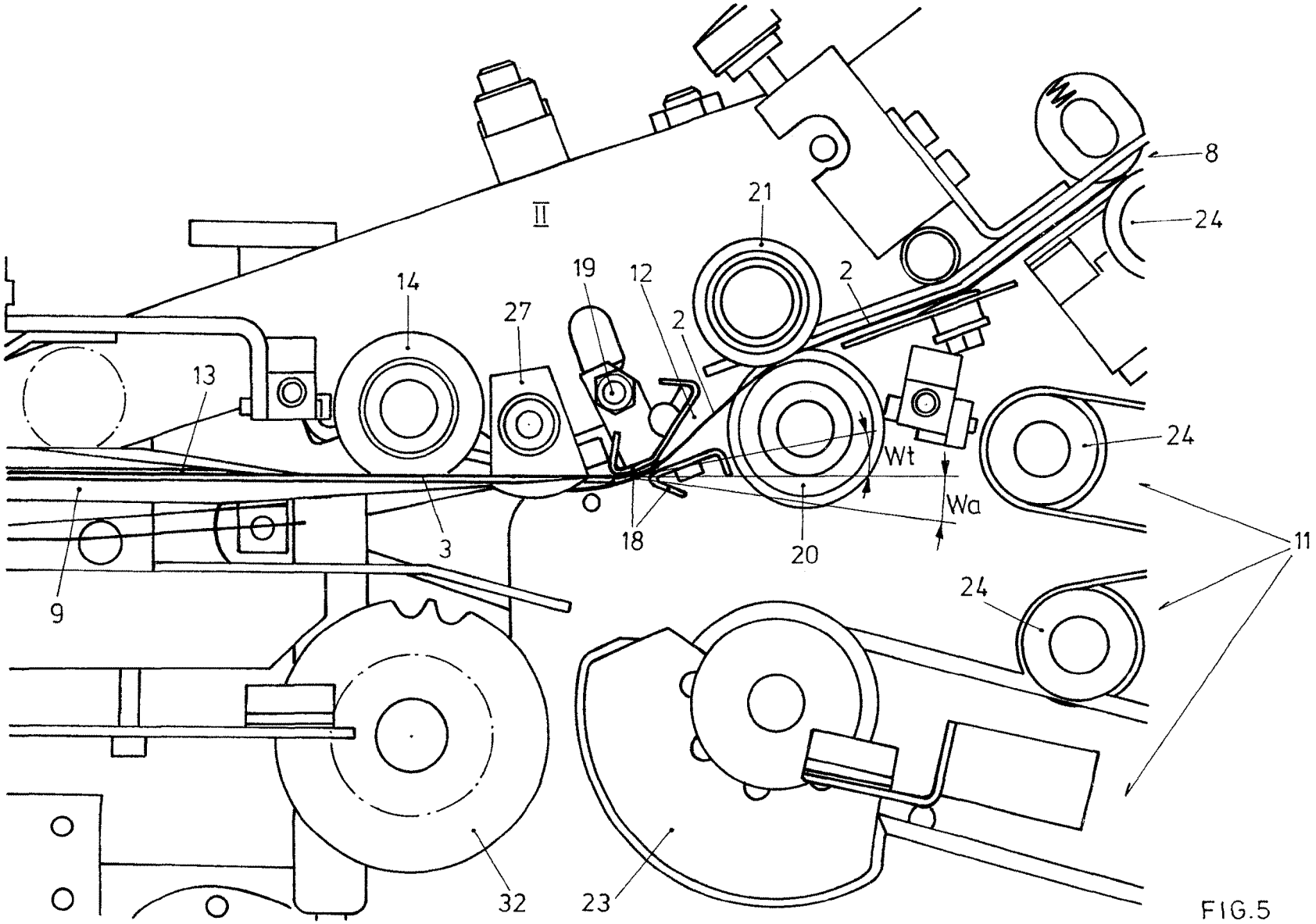
FIG. 5 shows an exemplary embodiment corresponding to FIG. 3.

In a manner analogous to the diagram shown in FIG. 3 for pulling an envelope onto the packing pocket, FIG. 5 shows in detail an example according to the invention of an inserting system. Besides the functional elements already mentioned above, such as the packing pocket 9 and the pulling roller 14 which is coupled to the movement of the funnel 12, it is also possible to see the toothed wheel 32 of the supply drive, a segment 23 which is advantageously elastic at least in the surface region, the transport roller and counter-roller 20, 21, as well as further details of the inserting system which is shown on a smaller scale in FIG. 1. These include for example further transport elements 8 and onward transport elements 11, which comprise further rollers and segments 24 and also transport belts and drive belts. Also shown is a cone 27, which is arranged between the funnel 12 and the pulling roller 14, for laterally delimiting the flap guide plane K and for assisting during the opening of the envelope, as well as details of the funnel base 19 to which the funnel 12 is attached and via which it is connected to the pulling roller 14. As described above, the funnel 12, which is formed of two angle profiles 18, guides the envelope immediately before and during the pulling thereof onto the packing pocket, and at the same time in this case, that is to say when the envelope is supplied from above, the lower angle profile 18 may be shaped in such a way that the lowermost surface thereof serves as a guiding surface during the onward transport of the envelope away from the packing pocket, before said envelope is gripped by the elastic element 23 and the transport roller and is conveyed further in the direction of the onward transport elements 11.

Figure 6:
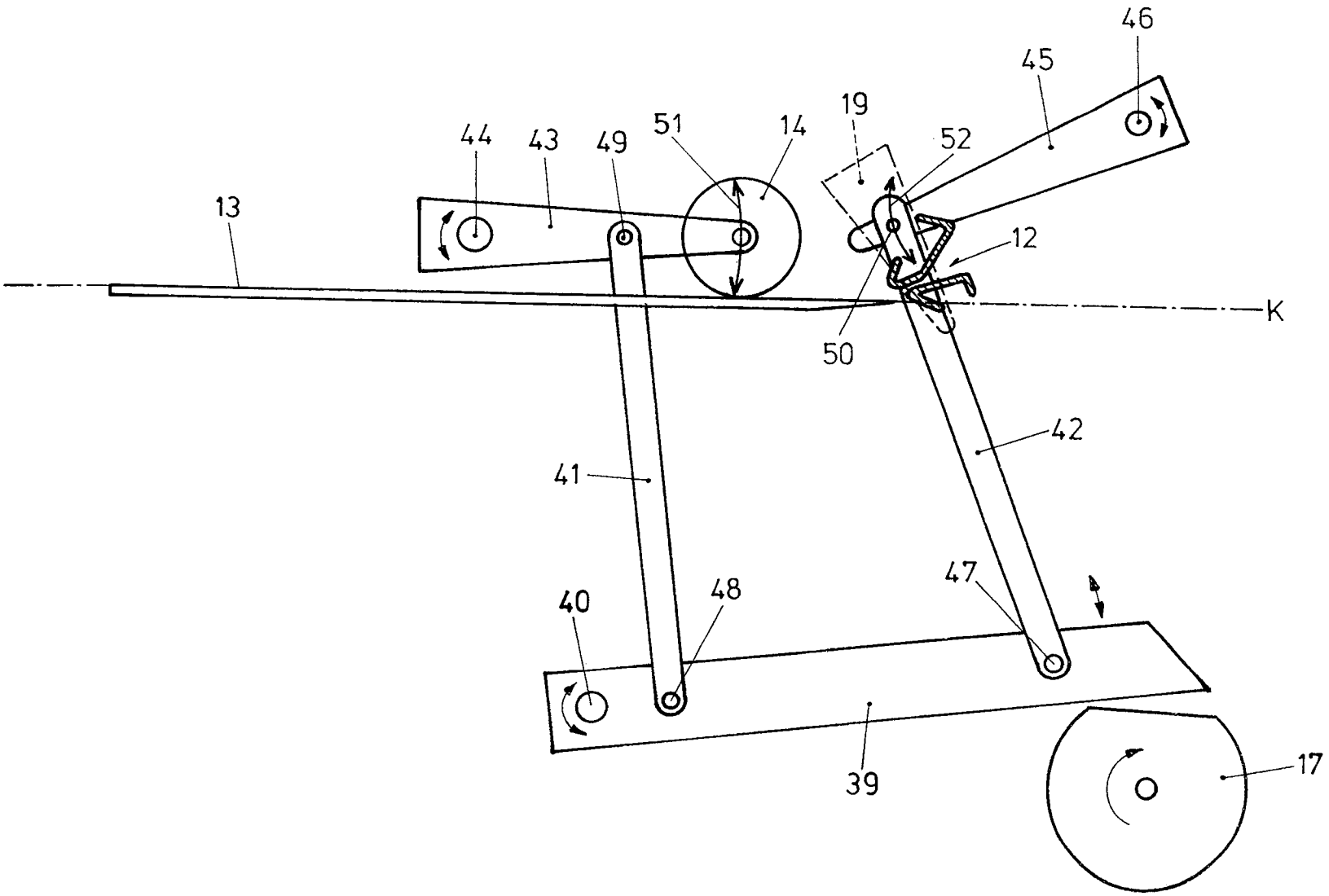
FIG. 6 shows a schematic diagram of a synchronizing mechanism.

FIG. 6 shows by way of example in a schematic detail view one possible embodiment of a synchronizing mechanism. Here, a cam 17 which is rotatably mounted on the inserting system raises and lowers a base rod 39 which is connected to the inserting system 1 via a pivot point 40 and to which in turn two transmission rods 41, 42 are attached by floating pivot points 48, 47, that is to say pivot points which move relative to the inserting system. Said transmission rods are in turn connected, in a manner shown in dashed line here, by floating pivot points 49, 50 to the functional rod 43 of the pulling roller 14 and respectively the functional rod 45 of the funnel base 19, in order to transmit the travel of the base rod. Due to the additional rotatable mounting of the functional rod 43, 45 on the inserting system 1, the pulling roller 14 and the funnel base 19 with the funnel 12 attached thereto are moved between the positions I and II along the circular movement curves 51, 52 and pushed toward or away from the flap guide side or a plane K that includes the latter. If the pulling roller 14 and the funnel base 19 with the funnel 12 are not attached to the functional rod 43, 45 as shown here, but rather are attached for example to the transmission rod 41, 42, a movement curve differing from the circular shape can be set. The same applies when the funnel base 19, for example via the pivot point 50, or/and the funnel 12 itself are additionally attached in a pivotable manner to the funnel base.

Similarly acting synchronizing mechanisms using other means are known in principle to the person skilled in the art and can accordingly be used, but a mechanism as shown which is based on cams and rods offers particular advantages in the case of rapid movement sequences which, as necessary here, additionally require high precision.

Figure 7:
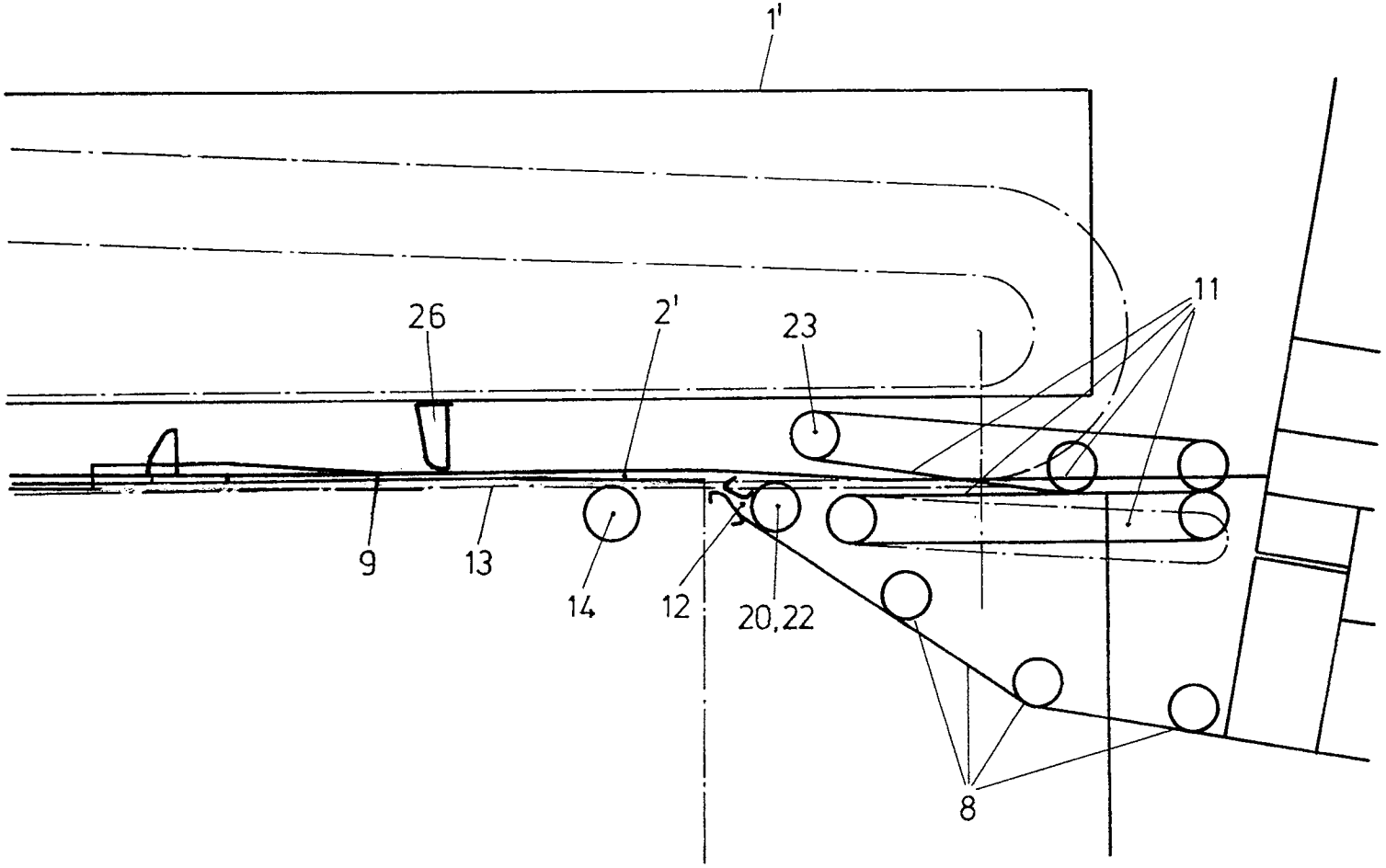
FIG. 7 shows a schematic diagram of an inserting system with envelopes being supplied from below.

FIG. 7 shows a further embodiment of an inserting system. Here, the envelopes are supplied onto the packing pocket 9 at an angle from the bottom right by way of the transport elements 8 and the transport roller 20; the outer side of the flap guide 13 is now directed downward. Here, too, the transport roller 20 guides the supply into the funnel 12, which is once again coupled to the pulling roller 14 and for its part guides the envelope flap onto the flap guide from below. Also when envelopes are supplied from below, a correspondingly synchronized movement of the funnel 12 and of the pulling roller 14 is carried out according to what has been described above. The insertion finger(s) 26 now guided above the packing pocket 9 push the envelope contents through the packing pocket 9 into the envelope, in order then to further convey the envelope together with the contents to the onward transport elements 11. The finger 26 may in this case be guided toward the onward transport plane beyond the flap guide 13 and the funnel. Here, too, the onward transport angle Wa is directed slightly downward relative to the plane formed by the flap guide 13, for example in a range from 1-6°.

FIG. 8 shows an adjustable packing pocket according to the invention, which can also advantageously be used on other inserting systems if these are to be configured in a flexible manner with regard to the envelope blanks and the packing mass. According to the exemplary embodiment shown therein, three so-called slats 28 are mounted on or below a mounting rail 15, here preferably an adjustment rail 35. While the (in this case one) inner slat 28" is attached in a stationary manner to the mounting rail or adjustment rail, the outer slats 28' can be moved transversely to the transport direction or onward transport direction in order thus to be able to set the packing pocket 9 in an optimal manner to different envelope widths. In the present example, the setting of the width is carried out by way of a manually operated adjusting spindle 31, but this can also be provided in an automatic manner, for example in an electrically driven manner. For flexibly attaching such a packing pocket 9 to the inserting system 1, a mounting stop 36 is provided here.

Figure 9:
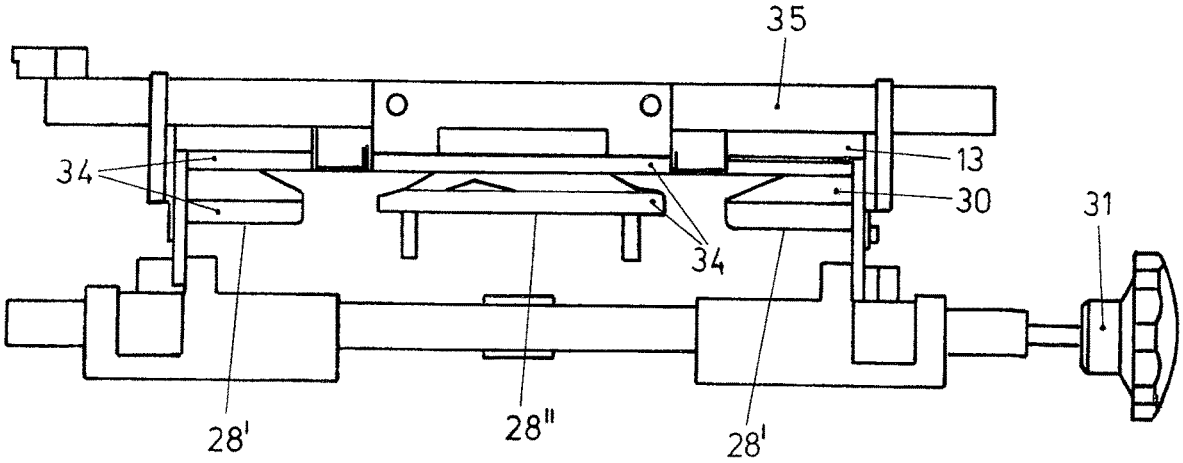
FIG. 9 shows a rear view of a packing pocket.

FIG. 9 shows a rear view of the packing pocket 9 shown in FIG. 8. Here, it is additionally also possible to see auxiliary surfaces 34 which are arranged upstream of the inner guide surfaces of the individual slats in the direction of supply of the envelope contents, so as to enable easier insertion of the contents into the packing pocket 9. In order to ensure that the envelope 2 is pulled onto the packing pocket 9 as reliably as possible, the side slats 28' as shown in FIG. 8 may be designed to project inward, toward the stationary inner slat or the mid-line M, in the region of the front edge facing toward the transport plane or onward transport plane. The outer side surfaces of the slats 28' are closed in order to laterally guide the envelope contents 5 and prevent the envelope contents from touching the envelope before the insertion operation is complete.

Figure 10:
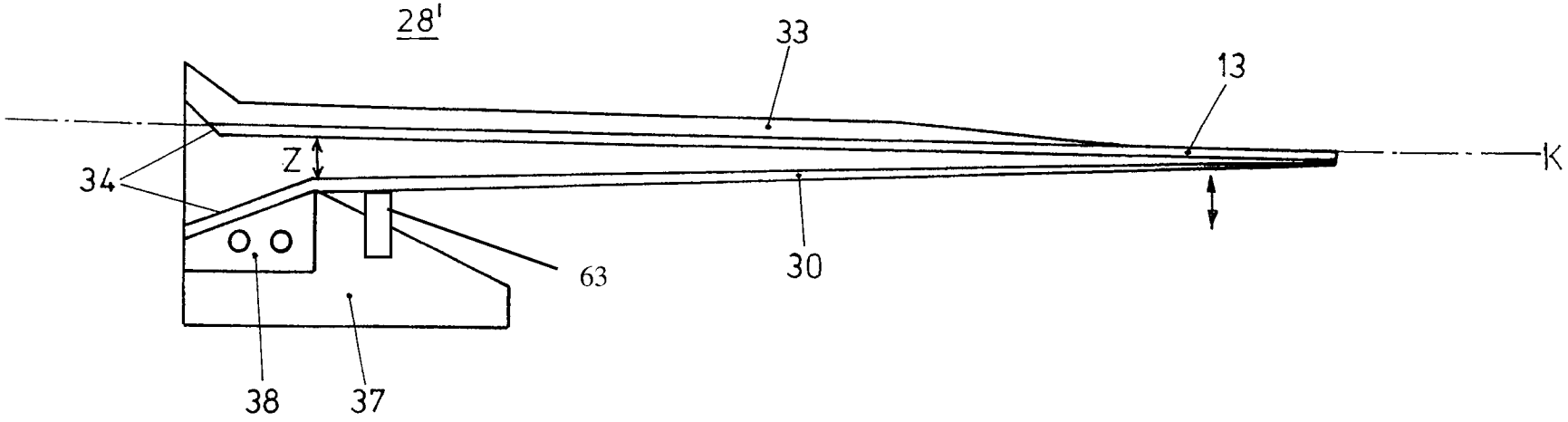
FIG. 10 shows a slat.

FIG. 10 shows by way of example the side view of an outer slat 28' as seen from the inside. The flap guide 13, as shown here at the top, and the sheet guide 30, shown at the bottom, are both provided with an auxiliary surface in the direction of the supply device 10. The side slat 28' comprises a slat base 37, which can be produced for example as a one-piece bracket with the flap guide 13, in order to increase the stability of the packing pocket. Alternatively, the slat 28' may be designed at least partially as a U-shaped profile with an outwardly directed base, so that the envelope contents are guided and/or supported by the outer slats through the U-shaped profile.

At the slat base 37, the sheet guide 30 may be attached in the rear region to a spring stop 38. The sheet guide 30, which is made of a flexible material, is inclined at an angle relative to the inner surface of the flap guide, so that in the front region it ends in the direct vicinity of the flap guide or even bears against the latter. Only by inserting the envelope contents is the sheet guide 30 pressed downward and exposes the route into the envelope or in the onward transport direction. As a result, even envelope contents which differ in terms of their thickness can be reliably supplied at the same speed. The maximum thickness of the envelope contents is defined in this case by a distance z, in the rear region, between the inner guide surfaces of the flap guide 13 and the sheet guides 30. As already mentioned in FIG. 7, in the case of an inserting system 1' being supplied from below, the packing pocket or the slats of the packing pocket are mounted inversely, that is to say with the flap guide at the bottom. In this case, too, the flap guide plane K may be identical to the horizontal plane, and in this case the rib 33 projects downward from the horizontal plane or the surface of the packing pocket and runs in manner inclined upward toward the rear.

Although individual aspects of the invention have been shown above in different exemplary embodiments, the individual aspects can readily be combined with one another within the scope of the routine knowledge of a person skilled in the art, provided that they do not rule one another out in a manner that is readily obvious to a person skilled in the art. Further embodiments will become apparent from the present disclosure and from the general knowledge of the person skilled in the art in respect of inserting and packing systems.

LIST OF REFERENCES

1 inserting system
1' inserting system supplied from below
2 envelope
2' filled envelope
3 envelope flap
4 flap fold
5 envelope contents
6 holder for empty envelopes
7 flap opener
8 transport elements
9 packing pocket
10 supply device
11 onward transport elements
12 funnel
13 flap guide (side)
14 pulling means, pulling roller
15 mounting rail
16 synchronizing means
17 guide cam/cam lobe
18 angle profile
19 funnel base
20 transport roller
21 counter-roller
22 onward transport roller
23 further onward transport element, segment
24 further rollers, segments
25 opener claw
26 finger
27 cone
28 slat

28' outer slat
28" inner slat
29 outer side surface of the slat
30 sheet guide
31 adjusting means, adjusting spindle
32 supply drive
33 rib
34 auxiliary surface
35 adjustment rail
36 mounting stop
37 slat base
38 spring stop
39 base rod
40 fixed pivot point of base rod
41 transmission rod to transport roller
42 transmission rod to funnel
43 functional rod for transport roller
44 fixed pivot point of functional rod
45 functional rod for funnel
46 fixed pivot point of functional rod
47, 48, 49, 50 floating pivot points of rods
I first position
II second position
l flap length
b envelope width
z maximum thickness of envelope contents
M mid-line
T, T', T" transport plane of the envelopes
K plane that includes the flap guide side
W1 movement angle of the funnel relative to the flap guide plane
W2 movement angle of the pulling roller relative to the flap guide plane
Wa onward transport angle
Wt transport angle

What is claimed is:

1. An inserting system for inserting envelope contents 5 into an envelope 2, wherein the inserting system 1, 1' comprises a holder 6 for empty envelopes, a flap opener 7 for opening an envelope flap 3 of the envelope 2, transport elements 8 for transporting the envelopes 2 from the holder 6 to a packing pocket 9 on which the envelopes are filled, a supply device 10 for supplying the envelope contents 5 to the packing pocket and into the packing pocket 9, and onward transport elements 11 for the onward conveying of the filled envelope 2', characterized in that the transport elements 8 comprise a funnel 12 for aligning the envelope 2 with the packing pocket 9, said funnel being movable in a first angle (W1) relative to a flap guide 13 of the packing pocket 9 which is mounted on the inserting system 1, 1' or on a mounting rail 15, and at least one pulling means 14 for at least partially pulling the envelope 2 onto the packing pocket 9, said pulling means cooperating temporarily with the flap guide 13 of the packing pocket 9 and being movable in a second angle (W2) relative to the flap guide 13, and synchronizing means 16 for synchronizing the movement of the funnel 12 and of the pulling means 14, as a result of which the funnel 12 and the pulling means 14 are movable from a first position I at receipt of the envelope flap 3 by the funnel 12 into a second position II after the envelope flap 3 has been placed onto the flap guide 13, and a transport angle (Wt) between the supplied envelope 2 and the flap guide 13 can be varied during the pulling of the envelope onto the packing pocket 9, in order to enable opening of the envelope, the packing pocket being mounted stationary on the inserting system or a mounting rail.

2. The inserting system according to claim 1, characterized in that the at least one pulling means comprises a pulling roller 14.

3. The inserting system according to claim 1, characterized in that, in the first position I, the transport angle (Wt) lies in a range between 15° and 45°, the limit values being included.

4. The inserting system according to claim 3, wherein the transport angle (Wt) lies in a range between 20° and 40°, the limit values being included.

5. The inserting system according to claim 3, wherein the transport angle (Wt) is 30°±5°, the limit values being included.

6. The inserting system according to claim 1, characterized in that, in the second position II, the transport angle (Wt) is smaller than in the first position.

7. The inserting system according to claim 6, wherein in the second position II, the transport angle (Wt) lies in a range between −10° and 10°, the limit values being included.

8. The inserting system according to claim 6, wherein in the second position II, the transport angle (Wt) is between 0° and 6°, the limit values being included.

9. The inserting system according to claim 1, characterized in that the synchronizing means 16 comprise synchronous motors, but preferably mechanical transmission means including at least one of toothed wheels, toothed belts, chains, drive belts, particularly preferably a guide cam 17.

10. The inserting system according to a claim 1, characterized in that the guide cam 17 is a cam disk or a cam lobe.

11. The inserting system according to claim 1, characterized in that the funnel 12 comprises two angle profiles 18 which are arranged parallel to and against one another, on opposite sides and transversely to the transport direction, and are mounted to be able to be moved by the means.

12. The inserting system according to claim 1, characterized in that the funnel 12 comprises two angle profiles which are arranged parallel to and against one another, on opposite sides and transversely to the transport direction, said angle profiles being mounted on a common funnel base 19 which is able to be moved the means 16.

13. The inserting system according to a claim 1, characterized in that an onward transport angle (Wa) formed between a plane K, which includes the flap guide 13, and the onward transport direction of the filled envelopes 2' is acute and directed downward, preferably in a range between 1° to 12°, the limit values being included.

14. The inserting system according to claim 1, characterized in that arranged upstream of the funnel 12 counter to the transport direction of the envelope 2 is a transport roller 20 which cooperates with a preferably spring-biased counter-roller 21 in order to transport the envelope 2 through the funnel 12 onto the packing pocket 9 as far as the pulling means 14.

15. The inserting system according to claim 14, characterized in that the transport roller 20, 22 is arranged between the transport plane and the onward transport plane so as to cooperate alternately or else simultaneously with the counter-roller 21 and the further onward transport element 23.

16. The inserting system according to claim 14, characterized in that the onward transport angle (Wa) from the front edge of the packing pocket 9 is acute and directed downward, preferably in a range between 1° and 12°, the limit values being included.

17. The inserting system according to claim 1, characterized in that provided downstream of the packing pocket 9 in the onward transport direction of the filled envelope 2' is an onward transport roller 22 and a further onward transport element 23 cooperating therewith for conveying the filled envelope 2' onward from the packing pocket 9.

18. The inserting system according to claim 17, characterized in that the further onward transport element comprises a segment 23, preferably a segment which can be spring-biased against the transport roller/onward transport roller.

19. The inserting system according to claim 1, characterized in that transport elements 11 or/and onward transport elements comprise further rollers or/and segments.

20. The inserting system according to claim 1, characterized in that the flap opener 7 is designed as at least one opener claw 25 arranged on a circular circumference.

21. The inserting system according to a claim 1, characterized in that the flap opener 7 comprises a blowing unit for generating an air flow that is directed below the envelope flap 3.

22. The inserting system according to claim 1, characterized in that the supply device 10 comprises fingers 26 attached to toothed belts or drive belts or chains.

23. The inserting system according to claim 1, characterized in that the first angle (W1) lies in a range from 90° to 150°, preferably in a range from 110° to 130°, relative to the plane K that includes the flap guide, the limit values being included.

24. The inserting system according to claim 1, characterized in that the second angle (W2) lies in a range from 70° to 110°, preferably in a range from 80° to 100°, relative to the plane K that includes the flap guide, the limit values being included.

25. The inserting system according to claim 1, characterized in that the first angle (W1) or/and the second angle (W2) can be varied, in particular can be varied by pivoting.

26. The inserting system according to claim 1, characterized in that cones 27 which are preferably adjustable and which laterally delimit at least the flap guide plane 13 are provided laterally between the pulling means 14 and the funnel 12 in order to easily open the envelope 2.

27. The inserting system according to claim 1, characterized in that the packing pocket 9 comprises a mid-line M in the plane K and also a plurality of slats 28 which are parallel to the mid-line M and which are arranged with the respective flap guide 13 in the plane K, wherein to at least two outer slats 28' with respect to the mid-line a sheet guide 30 is assigned, which is at a distance from the respective flap guide 13, and the slats 28 are arranged separately from one another on the inserting system 1, 1' or on a mounting rail 15, 35, wherein adjusting means 31 for displacing the side slats 28' are arranged for displacing the latter in parallel substantially perpendicular to the mid-line.

28. The inserting system according to claim 27, characterized in that at least one inner slat 28" is arranged in a stationary manner between the outer slats 28'.

29. The inserting system according to claim 27, characterized in that the sheet guide 30 is designed to be flexible relative to the flap guide 13 at least in a front region which is arranged at the front in relation to the envelope supply.

30. The inserting system according to claim 27, characterized in that the adjusting means 31 comprise electrical and/or mechanical means, preferably an adjusting spindle 31.

31. The inserting system according to claim 27, characterized in that the outer slats 28' are closed on the respective outer side surface.

32. The inserting system according to claim 27, characterized in that the outer slats 28' form at least partially a U-shaped profile with an outwardly directed base, so that the envelope contents 5 are guided on both sides by the U-shaped profile.

33. The inserting system according to claim 28, characterized in that the at least one inner slat 28" is open on both side surfaces.

34. A method for operating an inserting system 1, 1' according to claim 1, wherein, from a stack of envelopes stored in the holder 6, the flap 3 of the envelope 2 located closest to an envelope removal opening of the holder 6 is opened by a flap opener 7, transport elements 8 transport the envelope 2 from the holder 6 to a packing pocket 9 on which the envelopes 2 are filled, whereat the packing pocket is mounted stationary on the inserting system or a mounting rail, and the envelope contents 5 are supplied to the packing pocket 9 by means of a supply device 10, and onward transport elements 11 convey the filled envelope onward, characterized in that a movable funnel 12 aligns the envelopes in the direction of the packing pocket 9, wherein said funnel is moved in a first angle (W1) relative to the flap guide 13 of the packing pocket 9, and a pulling means 14 which is moved in a second angle (W2) relative to the flap guide 13 pulls the envelope 2 at least partially, but preferably completely, onto the packing pocket 9, wherein it cooperates at least temporarily with the packing pocket 9, wherein additionally synchronizing means 16 for synchronizing the movement of the funnel 12 and of the pulling means 14 move these from a first position I for receipt of the envelope flap 3 by the funnel 12 into a second position II after the envelope flap 3 has been placed onto the flap guide 13, as a result of which a transport angle (Wt) between the supplied envelope 2 and the flap guide 13 is varied during the pulling of the envelope 2 onto the packing pocket 9, in order to facilitate opening of the envelope 2.

35. The method according to claim 34, characterized in that the first angle W1 and the second angle W2 is moved in a range from 70° to 150° relative to the plane K that includes the flap guide, the limit values being included.

36. The method according to claim 34, characterized in that the first angle W1 and the second angle W2 is varied by a rotational movement when moving from position I into position II and vice versa.

37. The method according to claim 34, wherein movement of the funnel from the first position I to the second position II decreases the transport angle (Wt).

38. A packing pocket for an inserting system 1, 1' for inserting envelope contents 5 into an envelope 2, wherein the packing pocket 9 comprises a mid-line M in a plane K and also a plurality of slats 28 which are parallel to the mid-line M and which are arranged with a flap guide 13 in the plane K, wherein the flap guide 13 is mounted stationary on an inserting system 1, 1' or on a mounting rail 15, 35, and to at least two outer slats 28' a sheet guide 30 is assigned, which is at a distance from the flap guide 13, characterized in that the sheet guide 30 is flexible relative to the flap guide at least in a front region which is arranged at the front in relation to the envelope supply.

39. The packing pocket according to claim 38, characterized in that the spring action of the sheet guide 30 is such that a speed of supply of the envelope contents 5 is substantially maintained for envelope contents of different thickness.

40. The packing pocket according to claim 38, characterized in that the sheet guide 30 is a spring.

41. The packing pocket according to claim 38, characterized in that the sheet guide 30 in the rear region is fixedly connected to the slat 28, to a mounting rail 15, 35 or to the inserting system 1, 1' and extends in a finger-like manner into the front region of the slat 28, directed at an angle relative to the flap guide 13.

42. The packing pocket according to claim 38, characterized in that the sheet guide 30 touches the inner side of the flap guide 13 in the front region of the slat 28.

43. The packing pocket according to claim 38, characterized in that the packing pocket 9 comprises a spring which biases the sheet guide 30 in the direction of the flap guide 13.

44. The packing pocket according to claim 38, characterized in that the slats 28 are mounted separately from one another and the packing pocket 9 has adjusting means 31 for displacing the outer side slats, which are on the outside relative to the mid-line, in order to displace these in parallel substantially perpendicular to the mid-line.

45. The packing pocket according to claim 38, characterized in that at least one inner slat is arranged in a stationary manner between the outer slats.

46. The packing pocket according to claim 45, characterized in that the at least one inner slat 28" is open on both side surfaces.

47. The packing pocket according to claim 38, characterized in that the adjusting means 31 comprise electrical and/or mechanical means, preferably an adjusting spindle 31.

48. The packing pocket according to claim 38, characterized in that the outer slats 28' are closed on the respective outer side surface.

49. The packing pocket according to claim 38, characterized in that the outer slats 28' form at least partially a U-shaped profile with an outwardly directed base, so that the envelope contents 5 are guided on both sides by the U-shaped profile.

* * * * *